US008813972B1

(12) United States Patent
Centers

(10) Patent No.: US 8,813,972 B1
(45) Date of Patent: Aug. 26, 2014

(54) SECONDARY SEPARATION SYSTEM FOR RECYCLABLES

(71) Applicant: Michael C. Centers, Danville, CA (US)

(72) Inventor: Michael C. Centers, Danville, CA (US)

( * ) Notice: Subject to any disclaimer, the term of this patent is extended or adjusted under 35 U.S.C. 154(b) by 0 days.

(21) Appl. No.: 13/659,623

(22) Filed: Oct. 24, 2012

(51) Int. Cl.
*B07C 5/00* (2006.01)
*B07B 15/00* (2006.01)

(52) U.S. Cl.
USPC ..... 209/555; 209/12.1; 209/930

(58) Field of Classification Search
USPC ..... 209/12.1, 21, 30, 38, 552, 555, 576, 209/930, 932
See application file for complete search history.

(56) References Cited

U.S. PATENT DOCUMENTS 5,341,937 A * 8/1994 Vos ..... 209/38
5,485,925 A * 1/1996 Miller et al. ..... 209/615
6,460,706 B1 10/2002 Davis
7,188,730 B2 * 3/2007 Centers et al. ..... 209/314
7,341,156 B2 * 3/2008 Bohlig et al. ..... 209/592
7,757,863 B2 7/2010 Bohlig
7,786,401 B2 * 8/2010 Valerio ..... 209/571
7,802,685 B2 * 9/2010 Allen et al. ..... 209/12.1
7,893,378 B2 2/2011 Kenny
7,994,448 B2 8/2011 Kenny
8,127,933 B2 * 3/2012 Bohlig et al. ..... 209/555
2003/0062294 A1 4/2003 Davis et al.
2004/0226865 A1 * 11/2004 Tse ..... 209/12.1
2005/0194293 A1 * 9/2005 Tse ..... 209/12.1
2006/0102524 A1 * 5/2006 DeFeraudy ..... 209/30
2006/0254957 A1 * 11/2006 Bohlig et al. ..... 209/12.1
2011/0024531 A1 * 2/2011 Valerio ..... 241/24.25
2011/0147501 A1 * 6/2011 Valerio ..... 241/24.25

OTHER PUBLICATIONS

"Directions for Recycling Plastics and Managing Plastics Residues"; Environment and Plastics Industry Council (EPIC); Mar. 2002.
"Plastics Sorting Optimization Guide"; Environment and Plastics Institute of Canada (EPIC); Mar. 2002.
"Materials Recovery Facility Technology Review"; Kessler Consulting, Inc.; Sep. 2009.
"Materials Recovery Facility Feasibility Study"; Kessler Consulting, Inc.; Sep. 2009.
Scavino, Edgar, et al.; "Application of automated image analysis to the identification and extraction of recyclable plastic bottles"; Ji Zhejiang University SCI A; 2009 10(6); 794.

* cited by examiner

*Primary Examiner* — Patrick Cicchino
(74) *Attorney, Agent, or Firm* — Fernandez & Associates, LLP

(57) ABSTRACT

Apparatus and methods for separating fractions having monetary value from residual streams from a MRF are disclosed.

9 Claims, 5 Drawing Sheets

MRF Facility at Pinellas County, Florida

Flow Diagram of Single Stream MRF

News Screen Fines System Flow Diagram

Figure 3 MRF Facility at Pinellas County, Florida
Flow Diagram of Single Stream MRF
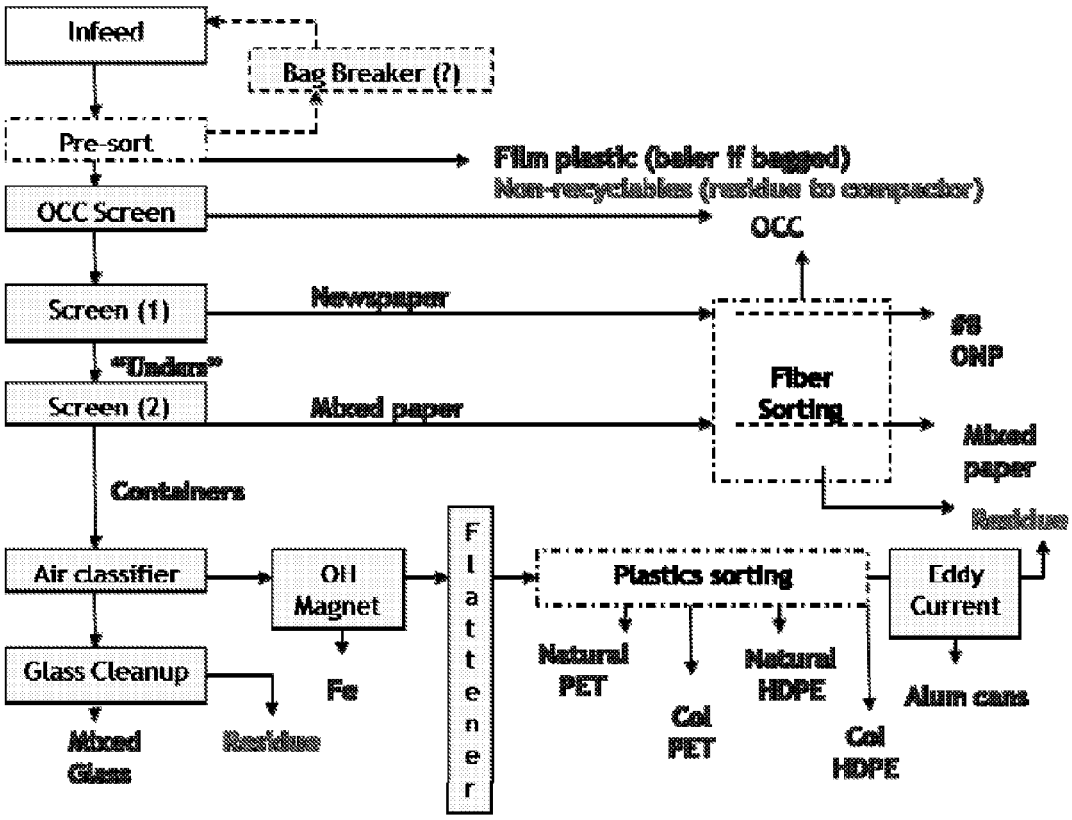

Figure 4A

*Pinellas County, Florida*
*Materials Recovery Facility Feasibility Study*
*Section 2: Needs Assessment*

Table 2.5: Recyclable Fiber and Containers in Commercial Waste Disposed

| Recyclable Material | Pinellas County Commercial Waste Stream (% by weight) |
|---|---|
| Corrugated Cardboard | 9.7% |
| Newspaper | 4.1% |
| Office Paper | 5.7% |
| Other Recyclable Paper | 9.2% |
| Total Fiber | 27.7% |
| HDPE Containers | 0.6% |
| PET Containers | 1.3% |
| Other Recyclable Plastic Containers | 0.5% |
| Tin/Steel Cans | 1.1% |
| Glass Containers | 5.9% |
| Aluminum Containers | 0.7% |
| Total Containers | 10.0% |
| **Total Recyclables** | **37.7%** |

Based on Pinellas County's 2007 Waste Composition Study.

Figure 4B

Table 2.6: Estimated Potential for Increased Recovery of Commercial Recyclables

| County | Commercial Waste Generated (tons) | Commercial Recyclables Recovered (tons) | Commercial Waste Disposed (tons) | Assumed %Fiber & Containers | Estimated Fiber and Containers Disposed (tons) | Target % for Additional Recovery | Estimated Potential for Additional Recovery (tons) |
|---|---|---|---|---|---|---|---|
| Pinellas | 829,060 | 293,892 | 535,168 | 38% | 203,364 | 25% | 50,841 |
| Hillsborough | 1,219,725 | 496,166 | 723,559 | 38% | 274,952 | 25% | 68,738 |
| Manatee | 319,575 | 124,162 | 195,413 | 38% | 74,257 | 25% | 18,564 |
| Totals | 2,368,360 | 914,220 | 1,454,140 | | 552,573 | | 138,143 |

SECONDARY SEPARATION SYSTEM FOR RECYCLABLES

CROSS-REFERENCE TO RELATED APPLICATIONS

This application incorporates U.S. Pat. No. 7,188,730 herein in its entirety by reference.

BACKGROUND OF THE INVENTION

1. Field of the Invention

The present invention discloses apparatus and methods for separating fractions of recyclable, processed material and/or trash, some fractions having monetary value.

2. Description of Related Art

Material recycling is an important industry due to decreasing landfill capacity, environmental concerns and diminishing natural resources. Many industries and communities have adopted recycling programs, voluntary or mandatory, for reusable materials. Until recently, most trash collection efforts delivered waste materials, separated at the source, e.g. by the home owner, to a Material Recovery Facilities (MRF). In an effort to improve the economies of collection municipalities are changing from curbside, source-separated to single stream, commingled, recycling methods. Many residential homes in North America have three choices: a container for green or yard waste, a container for solid waste or garbage and a container for recyclables; the trend is toward the same system for collections from apartments and businesses. When these materials are brought to a Materials Recovery Facility, MRF, recyclable materials are mixed together in a heterogeneous mass. This mixed, recyclable mass includes newspaper, magazines, mail inserts, mixed office paper, cardboard, aluminum cans, plastic bottles, glass bottles and other materials that may be recycled and some non-recyclable materials as well. Improvements in MRF design are required to handle the entire array of commingled material. A typical MRF recycles between about 40 to 90%, by weight, of the "recyclables" and landfills the balance, typically termed "the residual". Actual data is shown in FIGS. 4A and 4*b*; recyclables constitute about 62% of collected material in this Florida county. When a collecting entity collects recyclables separate from trash about 70% of the total stream is projected to be reclaimed. The instant invention is focused on the "residual"; residual is material left over after a first MRF processes, or separates out, items for "primary" recovery. In most cases there is sufficient economic value in residual to more than pay for additional processing based upon the instant invention disclosed herein.

U.S. Pat. No. 6,460,706; U.S. Pat. No. 7,188,730; U.S. Pat. No. 7,757,863; U.S. Pat. No. 7,893,378; U.S. Pat. No. 7,994,448; U.S. Pat. No. 8,127,933; and U.S. 2003/0062294 are examples of equipment developed to separate what is termed "single-stream" waste into fractions which have economic value and are incorporated herein in their entirety by reference. Currently, the single most abundant recyclable waste product is newspaper and other paper based products. The products of CP Manufacturing, as exemplified in two of the above references, are focused primarily on recovering paper, plastic containers and metal cans. These items can represent 70 to 95% of the economic value in recyclable waste as it is constituted today. Additional background information can be found in: [1] "Directions for Recycling Plastics and Managing Plastics Residues"; Environment and Plastics Industry Council (EPIC); March 2002; [2] "Plastics Sorting Optimization Guide"; Environment and Plastics Institute of Canada (EPIC); [3] "Materials Recovery Facility Technology Review"; Kessler Consulting, Inc.; September 2009; [4] "Materials Recovery Facility Feasibility Study"; Kessler Consulting, Inc.; September 2009; the four documents are incorporated herein in their entirety by reference. [5] SCAVINO, EDGAR, et al.; "Application of automated image analysis to the identification and extraction of recyclable plastic bottles"; Jl. Zhejiang University SCI A; 2009 10(6); 794; all are incorporated herein in their entirety by reference.

U.S. Pat. No. 7,188,730 discloses equipment developed to separate what is termed "single-stream" waste into fractions; one fraction is termed "news screen fines" (NSF); NSF is material characterized by being less than about 2.5" in one dimension such that a screen, optionally vibrating, is a suitable separating device. FIG. 1 is from U.S. Pat. No. 7,188,730; Fraction 1, [element 105], is the focus of U.S. Pat. No. 7,188,730; Fraction 2, [108], is part of the focus of the instant invention along with other residual streams. The U.S. Pat. No. 7,188,730 invention enables separation of most, recyclable, waste products, including newspaper and other paper based products. U.S. Pat. No. 7,188,730 focuses on reclaiming those materials (under five inches) and offers significant economic value to users.

Most recycling operators, termed MRF's, focus on separating a waste stream into fractions comprising cardboard and newspaper, mixed waste paper, glass, aluminum, PET, HDPE, and Tin; see FIG. 3. These seven materials have the most value and volume; as used herein, these materials are defined as the Big 7. Typically, Big 7 materials are sorted by material type when the volume of these sorted fractions is large enough to sell in truckload quantities on a monthly basis. These materials are also defined as High Critical Mass Materials. Characteristics of High Critical Mass Materials are: (1) once separated they have value and can be sold to markets on a predictable and consistent basis (2) given the value and the volume, the MRF is able to invest in equipment to separate and meet end user quality specifications (3) the materials are used in a home frequently enough where the resident has well established habits of placing in the recycling bin and (4) two or more end users or recycling facilities are available in the area such that a MRF has a buyer for the recovered, separated material.

Several significant trends are changing the landscape for single stream material recovery facilities creating a need for secondary and/or tertiary sorting systems to assist in further separation. (1) Introduction of new packaging materials that are less harmful to the environment or are cheaper to use than the "Big 7". (2) Residents are confused as to what is recyclable and what is not; people tend to throw anything that is "dry" in the recycling container. (3) "Big 7" materials are not the only materials in the stream and (4) manufacturers of new packaging (non-Big 7) are motivated to label their package as recyclable so that these products have an end of life story that includes recycling. These trends and the existing mechanized system for separating single stream materials at MRFs present an opportunity to capture, by separation, materials a MRF cannot process economically with currently available equipment. The material not separated by material type at a MRF is "unprocessed garbage, also termed "the residual", and is sent to a landfill; alternatively residual is exported so that less expensive labor can "mine" for the big 7 and other economic items. Materials a MRF cannot separate economically are increasing in volume. MRF designs call for separation of the big 7; however municipalities and residents tend to throw other items into the recycling bin which results in cross-contamination of the big 7 and additional residual after the first MRF separates the material. Typically, the collection process is fixed at 3 containers at a residence or a commercial business; the need to separate additional material the first MRF cannot is increasing and is the purpose of the instant invention.

Driven by the value of plastics, optical sorting capable of segregating by plastic type has become prevalent. However the complexity of today's waste stream with multiple sized bottles and various shaped containers erodes the efficiency of conventional optical sorting equipment. It is advantageous to increase the sorting selectivity and capability applied to a recyclable stream such that a finer resolution of various material sizes and types is achieved. In this manner a higher level of recyclable material can be reclaimed and still maintain a value proposition.

Creating a capability to separate mixed and rigid plastics creates operational efficiencies for a first MRF. The first MRF can focus on high critical mass plastics, types resin no. 1 (PET) and resin no. 2 (HDPE). The quality of both an initial separation stream and a secondary separation stream improves when the first MRF has an outlet for materials it cannot separate economically. A local processing option allows the first MRF to focus on quality of the big 7 materials it is designed to separate; the instant invention provides this local processing option. Pressure to separate large volumes results in cross contamination of the big 7; additionally, pressure to reduce residual disposal to landfills results in adding a percentage of mixed plastics or residual to the big 7 outbound loads; the instant invention reduces this "contamination". Brand owners who use plastics not made of resin no. 1 or no. 2 benefit from a local processing option that can identify and recycle their package material. Extended producer responsibility laws or shareholder pressure due to sustainability goals set by corporations and shareholder activists force brand owners to determine how best to recycle their product and package. A local processing option for materials a first MRF cannot process gives these brands data on the end of life for their package and also a potential separation solution. This data may be used to develop an EPR, Extended Producer Responsibility report, or other report to local municipalities, states, and manufacturers on recycling rates. Furthermore, the data capture capability built into the instant invention provides information to manufacturers by material type with a built in capability to identify brand type. This data assists manufacturers and municipalities to calculate recycling rates by material type and/or brand, the cost to recycle by material type and/or brand and the carbon footprint for end of life by material type and/or brand. Metrics across recycling rates for all plastics types including mixed media plastics are critical data and valuable to many stakeholders. Capturing this data prior to shipping the material offshore or landfill or for use in an alternative energy generator is critical to material manufacturers and brand owners. Critical given trends in EPR and diversion at the State level. The instant invention e enables a network of secondary MRFs that provide critical data across low critical mass packaging that is in the existing and future recycling systems. This national data base will be critical to EPR advocates who are looking to define the costs associated with recycling materials and brands after a consumer discards via recycling in the current three bin system. Manufacturers who choose to make a product or package must also insure they dispose of that package at the end of life; when the manufacturer provides for or enables a recycling end of life solution the product scores better with consumers and governments rating agencies concerned with carbon footprint and landfill usage.

BRIEF SUMMARY OF THE INVENTION

The benefits of the instant invention include: (1) reducing the amount of residual going to landfills; (2) reduction of the carbon footprint and cost of shipping mixed plastics overseas; (3) reduction of the pollution generated in shipping this material overseas; (4) opportunities to separate other materials (non-Big 7) by material type to enable recycling; (5) Jobs are created close to where this material is collected; (6) Fraction 10 of FIG. 2A, the final fraction, may be a renewable energy source. (7) By implementing a local, secondary MRF, a first MRF is free to focus on the Big 7 materials improving the effectiveness of these plants. (8) The instant invention uses air for separation; this air separation significantly reduces ongoing maintenance costs associated with disc screen separation or that of ballistic separation. Annual costs savings using the instant invention are projected to exceed $90,000 per year per equivalent disc screen unit. There are currently two other streams that conventional MRFs do not process or separate; the instant invention discloses a method to economically sort low critical mass and/or low volume materials that represent the majority of these streams. The instant invention, also termed a "Semi-Portable Separation System", enables separation of materials a MRF currently cannot afford to separate onsite. There are approximately 600 to 800 single steam MRFs in the United States; all use conventional technology to separate the Big 7 and paper from containers and then containers from each other. The residual steams that are left behind comprise the "unsorted trash and recyclables" from a container line and from a mixed plastics line. The container and mixed plastics residual comprise materials 12", in a single dimension, or smaller. The targeted materials may comprise Big 7 items and mixed plastics type numbers 3-7, plus film, aseptic containers, cable top cartons, biodegradable plastics and batteries. When a material does not have some minimum economic volume then a first MRF cannot afford the investment to separate this material for reclaim.

The instant invention is focused on separating and recovering various paper, plastics and metallic objects not currently captured by conventional MRFs and not addressable with the NSF Separation Systems of U.S. Pat. No. 7,188,730. In some embodiments a "Secondary Separation System for Recyclables", SSSR, comprises at least one shaker screen module and a plurality of pneumatic separation modules, each operating at different air velocities and operable in a fashion that removes light, large objects, such as newspaper, first and more dense, bulky objects, such as water bottles, last. In some embodiments the output of a "SSSR", including various fractions separated within the SSSR, may proceed to optical sorting for further classification. FIG. 2 shows an exemplary embodiment of the instant invention.

BRIEF DESCRIPTION OF THE DRAWINGS

FIG. 3 is a MRF Facility in Pinellas County as disclosed in the Kessler Report.

FIGS. 4A and 4B show the waste and recyclable fractions as disclosed in the Kessler Report.

DETAILED DESCRIPTION OF THE INVENTION

In the following description, numerous specific details are set forth to provide a thorough understanding of the present invention. However, it will be apparent to one of ordinary skill in the art that the invention may be practiced without these particular details. In other instances, methods, procedures, and components that are well known to those of ordinary skill in the art are not described in detail to avoid obscuring aspects of the present invention.

The NSF Separation System of U.S. Pat. No. 7,188,730 can be configured as an addition to a conventional single stream processing system or stand by itself or be configured as a portable system and can be used to conduct material audits. The instant invention, SSSR, discloses an apparatus and process for optimizing recovery of material from a stream comprising mixed plastics of types 1-7, film, glass and grit and paper from shredded size to a full newspaper page. In some embodiments the instant invention also includes optical, magnetic, electrical and other means for sorting to classify and segregate plastics, metals, paper and other materials as part of the system. Alternative embodiments of the instant invention handle waste material with dimensions from 0.1 to 18" and weights from less than a gram to a kilo-gram or more up to and including 5 gal. bucket sizes; the invention has various configurations as one knowledgeable in the art will appreciate.

Figure 1:
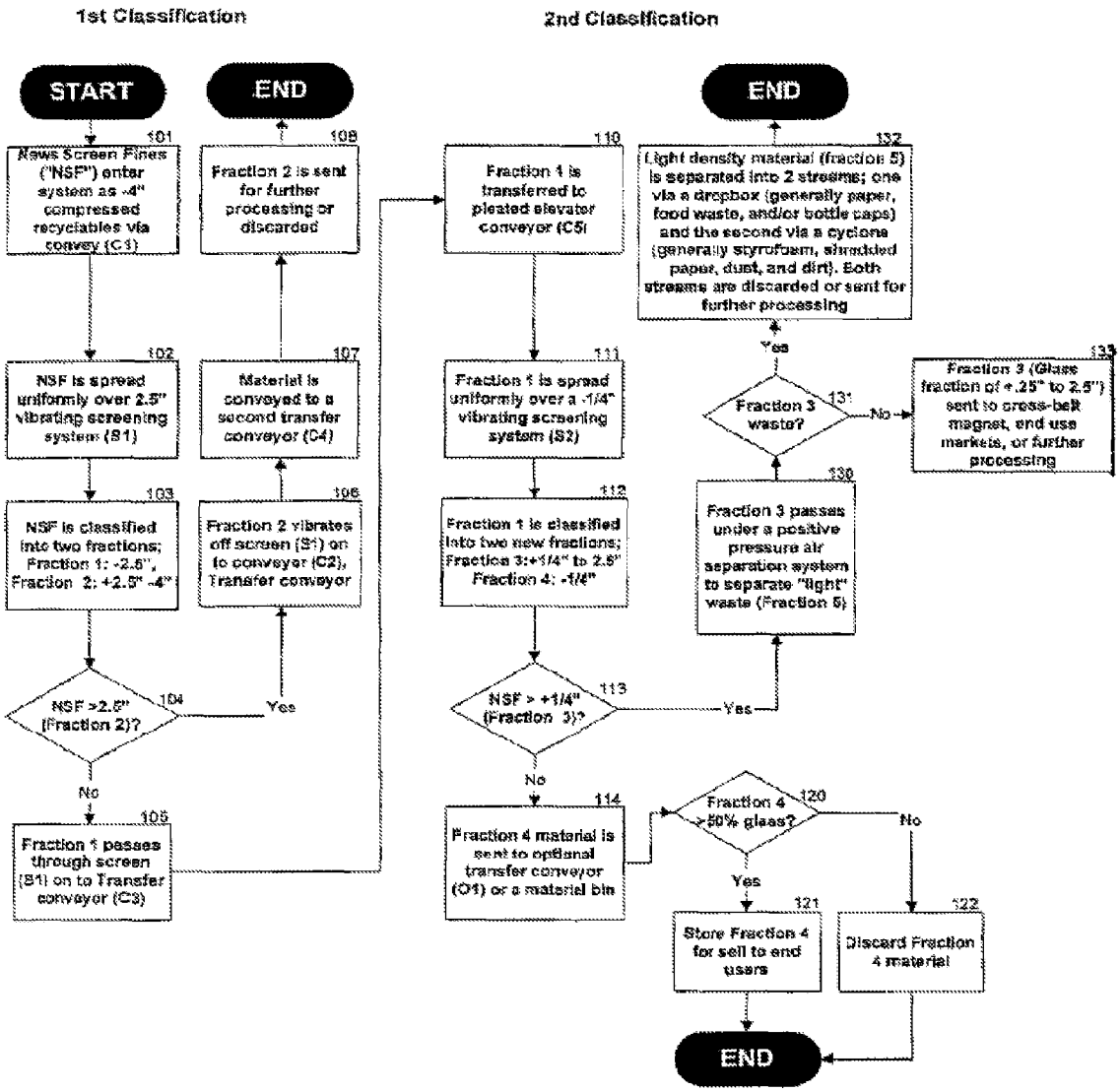
Prior Art Figure 1
FIG. 1 is a flow diagram for a separation system disclosed in U.S. Pat. No. 7,188,730.

In some embodiments the sources of material for a disclosed SSSR comprise the material of FIG. 1 labeled Fraction 2, 108. In some embodiments the sources of material for a disclosed SSSR comprise the materials of FIG. 3 labeled "Non-recyclables" and/or "residue"; in some embodiments the sources of materials for a disclosed SSSR comprise various combinations of materials of FIG. 1 labeled Fraction 2, 108, materials of FIG. 3 labeled "Non-recyclables" and/or "residue" and, optionally, other materials an entity processing waste comprising recyclables finds uneconomic or inconvenient to process. An object of the disclosed invention is to economically process material streams comprising recyclables intended for landfill into streams of recyclable material and waste.

Conventional MRFs operate with at least some of the following equipment: 1) Incline feed or drum feeder; 2) a presort; 3) Old Cardboard Container, OCC, Removal Screen; 4) News Screen; 5) mixed waste paper screen; fall-out from these screens either goes direct to a container line or to a special screen designed to remove light paper and film. An optional configuration removes the news screen fines via a glass crusher to size and/or a screen to remove items under approximately 2 inches. For all material under two inches, if that material is mostly glass, a glass clean up system is added. Another example is a NSF separation system, U.S. Pat. No. 7,188,730. The remaining material above 2 inches and what falls through an OCC removal screen, news screen and mixed waste paper screen are transported to a container line. A typical container line uses human pickers and/or optical sorters to remove PET, HDPE and, in some configurations, mixed plastics; optionally, a cross belt magnet may remove ferrous materials and, optionally, an eddy current separator may be used to remove aluminum and/or non-magnetic metallics. After the various separation processes on the various lines, the material that is left over is called a "residual stream" or "residue" or "non-recyclables" or other term meaning the material is to be land-filled. FIG. 3 shows the process streams for Pinellas County as reported in the Kessler Consulting report of September 2009.

Figure 2A:
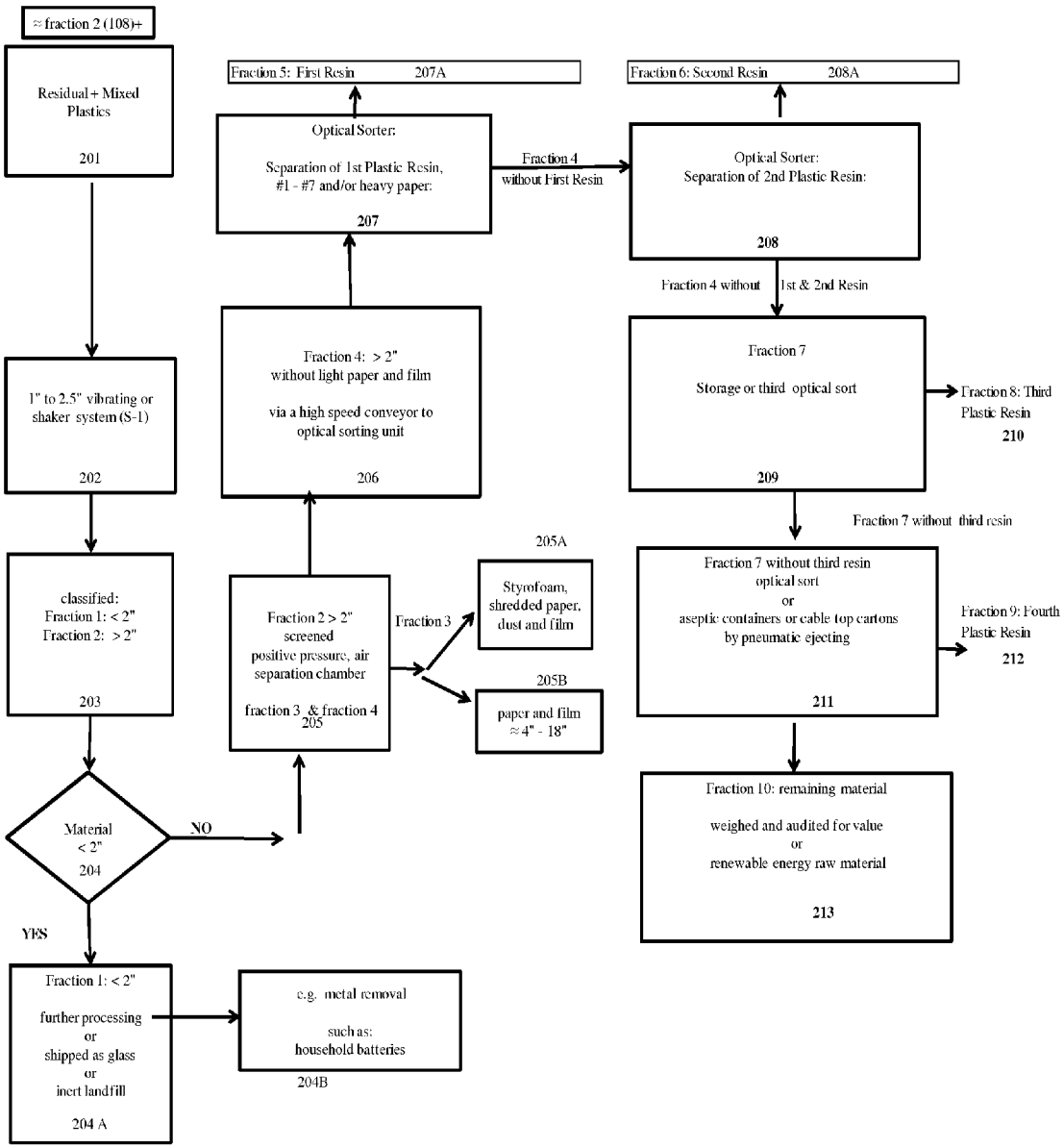
FIG. 2A is a flow diagram for one embodiment of a SSSR disclosed herein.
Figure 2B:
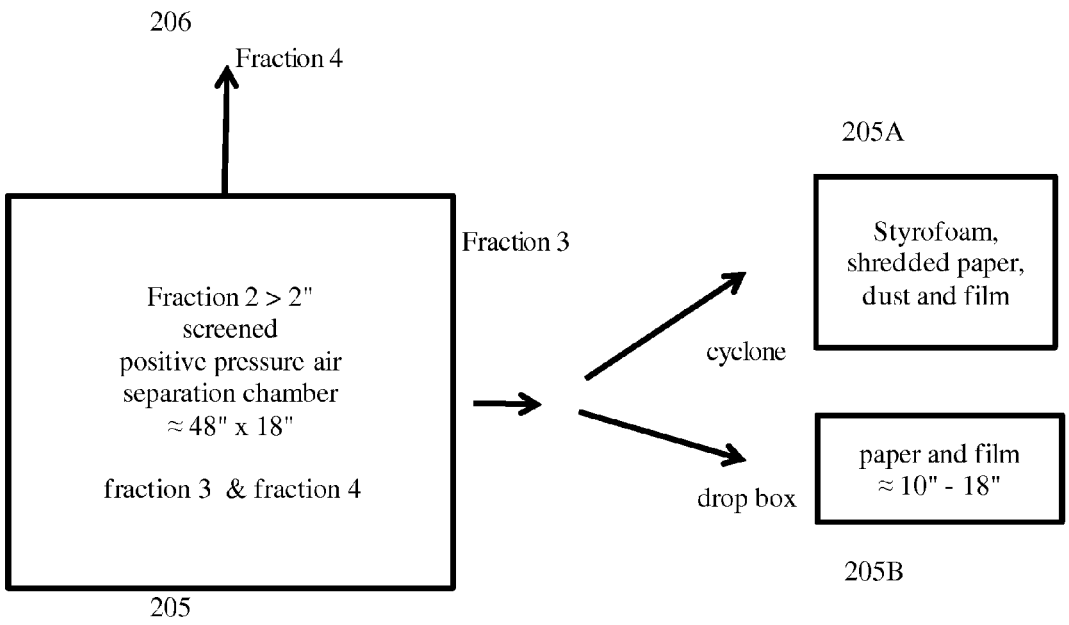
FIG. 2B is a flow diagram for one portion of one embodiment of a SSSR disclosed herein.

FIG. 2A shows an embodiment of a SSSR apparatus. Material such as 108 of FIG. 1 and "residue" of FIG. 3 enter an SSSR apparatus at 201, typically a 48 inch wide conveyer. 202 and 203 perform a first separation into Fraction 1, less than about 2 inches, and Fraction 2, greater than about 2 inches; 2 inches refers to the smallest dimension of an object being processed. Fraction 1 is processed further for glass and/or metal removal as shown in 204A and 204B. Fraction 2 proceeds to a first pneumatic air separator, 205. Fraction 3, separated out at this step, comprises styrofoam, shredded paper, dust, light film, all designated 205A, and heavier paper and heavier film, designated 205B. FIG. 2B shows that the heavier fraction, 205B may be captured in a drop box; the lighter fraction, 205A, may be captured in a cyclone. Fraction 4, substantially free of materials comprising 205A and 205B, proceeds to a next step. In some embodiments a next step is a repetition of step 205, not shown, with higher velocity air flows, both positive and negative, wherein two additional types of material are removed from the input stream 201. The two additional types of material may comprise plastic bottles or even heavier paper or cardboard, as noted in 207. Plastic bottles, empty or not, may be separated out; items up to and including 5 gal. buckets may be separated out using a variable air flow pneumatic separator comprising an upward flow source below a screen and a upward flow source above the screen; both sources independently controlled in their air flow velocities; the upward flow source above the screen comprises a drop box for the relatively heavier items and a cyclone for capturing the relatively lighter items.

Adjustment of air flow velocity may be accomplished by a variable speed drive (VSD) modulating the frequency, Hertz, for each blower motor. An operator may adjust the system using VSD to optimize the number or type of light materials removed via "negative air", the upward flow source above the screen. This is an important aspect of the invention; an operator may desire to remove light plastics such as 6 oz. bottles through the air system versus through the optical sorter to not only reduce demand on the optical sorters but also reduce the complexity of the stream into an optical sorter. In some embodiments a VSD has a range for the positive air, below the screen, of 10 Hz to 50 Hz. and a range for "negative air" may be from 25 Hz to 90 Hz. Exemplary pneumatic separators are offered by Twin City Fan and Blower Co. In some embodiments a positive air blower, blowing in an upward motion, of size 182 BAF, Arr 9, Class 1 Complete with access door, flanged outlet, inlet screen, belt guard, shaft and bearing guard, V-Belt drive, and a 5 HP, 1800 RPM, 460-3-60 TEFC Motor is used. In some embodiments a "negative" air blower, exhausting in an upward motion, from Twin City Fan and Blower Co. is a size 915 RBW, Arr. 9, Class 22, CW BHD, complete with access door, flanged outlet, inlet screen, belt guards, shaft and bearing guard, V-belt drive and a 40 HP, 460-3-60 TEFC, VDF Motor; rating 9,500 CFM, 15"SP, 2,036 RPM, 18.72 BHP.

The transition from the vibratory screen to the air separation is accomplished for all materials regardless of size using the art defined by the author in U.S. Pat. No. 7,188,730. The difference is scaling of the transition chute, screens, and blowers. In the original art the material was typically under 2.5 inches in size and the screen width no more than 48 inches in size. In this application the material is less than 12 inches in size and the screen width may be 60 to 72 inches in width. By creating the air chute the same length as the vibratory screen you get flawless separation.

FIG. 4A shows an analysis of recyclable material from Pinellas County in 2007; about 38% of the waste received was sorted into the various categories for recycling. FIG. 4B shows an analysis of increased recovery of recyclable material from Pinellas County wherein an additional 25% of material previously classified as residual or landfill is separated as recyclable. Note that of the 2,368,360 tons of waste collected and processed with "increased recovery" techniques 1,315,997 tons with an estimated 414,430 tons of recyclables still go to the land fill. Based on these numbers, about 31% of the material landfilled is recyclable by "conventional MRFs"

using "Increased Recovery" techniques. An object of the disclosed invention is to reclaim a majority of the "31%" now going to a landfill.

Table 1 shows the result of one embodiment of the disclosed invention. The "before" analysis shows that plastics comprise about 11.6% of a residual stream. After processing by an embodiment of the disclosed invention wherein about 90% of several "high waste" categories are removed, including 90% of the "trash", plastics now comprise about 62% of a stream with considerable economic value.

TABLE 1

| | RESIDUAL HEAVY STREAM | | | | | | | (weight percent) | | | | |
|---|---|---|---|---|---|---|---|---|---|---|---|---|
| | PET (1) | HDPE (2) | PVC (3) | LDPE (4) | PP (5) | PS (6) | OTHER (7) | PAPER | METAL | WOOD | GLASS | TRASH |
| Before | 4.5 | 4.5 | 0.1 | 0.1 | 2.1 | 0.3 | 0.2 | 44.5 | 8.2 | 1.5 | 3.5 | 30.5 |
| After | 23.5 | 23.7 | 0.4 | 0.5 | 11.1 | 1.5 | 0.9 | 23.4 | 4.3 | 0.8 | 1.8 | 8.0 |
| % removal | | | | | | | | 90.0% | 90.0% | 90.0% | 90.0% | 95.0% |

[Removal percentages are ±5%]

In some embodiments an apparatus for processing a residual stream from a MRF, optionally termed a SSSR, comprises a means for conveying not less than 12 inches wide; a screen portion comprising openings greater than about 2.5±1.0 inches in a lateral dimension such that a first fraction comprising material with a lateral dimension less than the screen openings falls through the screen openings; and a first positive pressure air separation module comprising a first portion below the screen with an upward blowing air stream of first controllable velocity and a second portion above the screen with a negative pressure inlet of second controllable air stream velocity operating such that a second fraction comprising material with a apparent density less than a first apparent density and a lateral dimension greater than the screen openings are blown up and into the second negative pressure inlet; and, optionally, a second positive pressure air separation module comprising a second portion below the screen with an upward blowing air stream of third controllable velocity and a second portion above the screen with a second negative pressure inlet of fourth controllable air stream velocity operating such that a second fraction comprising material with a apparent density greater than the first apparent density and less than a second apparent density and a lateral dimension greater than the screen openings are blown up and into the second negative pressure inlet; wherein the remaining, processed residual stream consists of matter made up of components with a apparent density greater than the second apparent density and a lateral dimension greater than the screen openings and composition at least 25% by weight of plastics with number designations 1 through 7 and paper based items.

In some embodiments an apparatus for processing a residual stream from a MRF, optionally termed a SSSR, comprises a video camera attached to a computing device, comprising a data base, operable to process a pattern recognition program such that images of items removed from the means for conveying by the first and second positive pressure air separation module are input into the pattern recognition system and catalogued by the pattern recognition system and stored in the data base such that future retrieval is enabled. In some cases an operator must adjust manually the control parameters of the first and second positive pressure air separation modules such that a pattern recognition system can learn the proper patterns for separation by the first and second positive pressure air separation modules. In this way items of a first type, such as plastic grocery bags, can be pneumatically separated from items of a second type such as empty plastic bottles with the goal that an operator is needed only for initial setup of the equipment. In some embodiments there are additional positive pressure air separation modules.

In some embodiments a data base includes historical data about a MRF supplying a residual stream for processing by the instant invention. Such data may include a tracking number; characteristics of past residual streams including composition, weight fractions of various categories, such as plastic, paper, metals and other items of interest and other details to facilitate operation of a pattern recognition system; in some cases data acquired apart from the pattern recognition system is entered into the data base; such data may comprise information collected by an operator or system associated with the SSSR. In some embodiments a data base comprises information on past payments to a MRF; in some embodiments a payment for a portion of a residual stream to a MRF is based on data acquired by the pattern recognition system or otherwise entered into the first or second data base.

In some embodiments a SSSR comprises a system supplied by Agilyx of Beaverton, Oreg. wherein plastic is not separated by plastic number type but aggregated together such that the plastic may be converted to oil.

In some embodiments an apparatus for processing a residual stream from a MRF, optionally termed a SSSR, comprises a first and second optical scanning device operable to distinguish one plastic number type from another plastic number type by reflection or transmission spectroscopy or other optical "fingerprinting" techniques. Historically the plastic number types are:

TABLE 2

| | |
|---|---|
| Number 1 Plastics: | PET or PETE (polyethylene terephthalate) |
| Number 2 Plastics | HDPE (high density polyethylene) |
| Number 3 Plastics | V (Vinyl) or PVC |
| Number 4 Plastics | LDPE (low density polyethylene) |
| Number 5 Plastics | PP (polypropylene) |
| Number 6 Plastics | PS (polystyrene) |
| Number 7 Plastics | Other, including polyactide, polycarbonate |

Manufacturers of mass-feed optical sorting systems claim separation "purity" of 90 to 95 percent. Typically, at least one sensor is required for each type of plastic sorted. Two sensors can be used in a series to increase the sorting sensitivity or to sort another stream. Manual quality-control sorting is usually required as a final step when using this equipment, should only one pass be done automatically. There are several different manufacturers of optical-sorting or equipment of the type used for the sorting of plastic bottles. As used herein the term "optical recognition" comprises at least two types of equipment, pattern recognition systems and optical sorting systems; the term "optical recognition" is meant to apply to all systems using an "optical" or "radiation" based detector as a primary sensing capability for the purpose of distinguishing various types of compositions and/or shapes, colors or surface features. Examples of optical recognition systems include 1) MSS: based in Nashville, Tenn. Produces two systems, with options of separating multiple resins from a mixed plastics and paperboard stream; five models vary in throughput capacity from 1,500 to 4,000 kg/hour; optionally, an integrated color sensor differentiates among clear and green PET bottles or transparent and opaque, plus colored and natural HDPE bottles; 2)National Recovery Technologies Inc., based in Nashville, Tenn., uses infrared sensing technology to sort one designated plastic polymer type from a commingled stream; 3) Ti Tech, based in Norway, uses up to four detection techniques in order to detect material types, colors, shapes, textures and paper grades; also includes fast-scanning, near infrared spectrometer; can sort an input stream up to 10 tons/hr with purity in the 90-98% range, for waste, mixed plastics, PET bottles, paper; 4) Pellenc Selective Technologies, based in France, uses NIR, near infrared spectroscopy, technology to identify all materials in one pass; options include ability to identify each object by location, shape, transparency and color, such as light blue, clean and green transparent objects and opaque objects; models range from 80 cm to 2.4 meter belt widths, up to 10 ton/hr; 5) S&S Separation and Sorting Technology GmbH, based in Germany, joint ventures with California company, Tectron Engineering, produces optical sorting equipment for whole bottle sorting, and works with different polymer types, colors and metals, as well as a commingled stream of mixed plastics; 6) Sherbrooke O.E.M., based in Quebec, offers a line of optical and NIR sorting with one single processor camera that can control multiple sorting units. In all cases throughput speed and yield can be improved by reducing the complexity or variations in material to be sorted as disclosed in the instant invention.

In some embodiments a secondary separation system comprises a first pattern recognition system comprising a first data base operable to distinguish components of the second fraction such that the velocity of the positive pressure air of the first part of the first air separation module is determined by the settings of the pattern recognition system. In some embodiments a secondary separation system comprises a second pattern recognition system comprising a second data base operable to distinguish components of the third fraction such that the velocity of the positive pressure air of the first part of the second air separation module is determined by the settings of the second pattern recognition system. In some embodiments the first and second data bases comprise data on at least one of the following: dimensions of components in the second and third fraction; grey scale percentage of the observed flow pattern; MRF supplier of the stream; air velocity settings versus various composition profiles; and recyclable percentage. In some embodiments the first and second data bases are shared. In some embodiments the MRF supplier is compensated based upon the data collected by the pattern recognition system.

In some embodiments an optical recognition system is operable to sense "mixed media" packaging wherein two or more materials conventionally disallowed to be recycled together are used; examples are paper with a wax overcoating for liquids or a metallic coating on plastic or paper. An optical recognition system may sense a wax surface or a plastic/metal interface thus enabling those materials to be separated without direct human assistance.

In some embodiments a secondary separation system for recyclables for processing a stream from a MRF comprises a means for conveying; a screen comprising openings greater than about 2.0±1.0 inches in a lateral dimension such that a first fraction comprising material with a lateral dimension less than the screen openings falls through the screen openings and is no longer part of the stream; and a first air separation module comprising a first part of positive pressure air and a second part operating such that the first part transports a second fraction comprising material with an apparent density less than a first predetermined number and a lateral dimension greater than the screen openings up and away from the stream wherein the remaining, processed stream consists of matter made up of components with an apparent density greater than the first predetermined number and a lateral dimension greater than the screen openings and wherein the second fraction is separated into a lighter second fraction and a heavier second fraction by the second part of the air separation module and wherein the processed stream exiting the first air separation module comprises between about 20% and 40% by weight of recyclable stream material; optionally, a secondary separation system comprises a second air separation module comprising a first part of positive pressure air and a second part operating such that the first part transports a third fraction comprising material with an apparent density less than a second predetermined number and a lateral dimension greater than the screen openings up and away from the stream wherein the remaining, processed stream consists of matter made up of components with an apparent density greater than the second predetermined number and a lateral dimension greater than the screen openings and wherein the third fraction is separated into a lighter third fraction and a heavier third fraction by the second part of the second air separation module and wherein the processed stream exiting the second air separation module comprises between about 30% and 60% by weight of recyclable material; optionally, a secondary separation system further comprises a first optical recognition system comprising a first data base operable to distinguish components of the second fraction such that the velocity of the positive pressure air of the first part of the first air separation module is determined by the settings of the optical recognition system and wherein current data acquired by the first optical recognition system is stored in the first data base; optionally, a secondary separation system of further comprises a second optical recognition system comprising a second data base operable to distinguish components of the third fraction such that the velocity of the positive pressure air of the first part of the second air separation module is determined by the settings of the second optical recognition system and wherein current data acquired by the second optical recognition system is stored in the second data base; optionally, a secondary separation system further comprises a tertiary sorter positioned after the second air separation module wherein the processed stream into the tertiary sorter is characterized by the fact that the composition of the processed stream comprises less than between about 20% and 40% by weight of non-recyclable material; optionally, a secondary separation system is configured such that the first and second data bases comprise historical data specific to the stream from a MRF being processed such that the first and second optical recognition systems can compare the current data to the historical data.

In some embodiments a composition of matter is derived by processing a residual stream from a MRF operating with conventional equipment wherein the residual stream is processed through at least one shaker screen comprising openings greater than 2±1.0 inches in a lateral dimension wherein a first fraction with a dimension less than 2±1.0 inches is removed and is processed through at least one air separation module operating such that a second fraction comprising material with a apparent density less than 0.1 and a lateral dimension greater than the screen openings is transported up and away from the processed residual stream using at least one negative pressure air separation such that the composition of the processed residual stream after removal of the first and second fractions, is between about 30% and 60% by weight of plastics with number designations 1-7 and paper based items including newsprint, cardboard, and film.

In some embodiments a method for processing a residual stream from a MRF comprises the steps; processing through at least one shaker screen comprising openings greater than 2±1.0 inches in a lateral dimension wherein a first fraction with a dimension less than 2±1.0 inches is removed; processing through at least one air separation module operating such that a second fraction comprising material with a apparent density less than 0.1 and a lateral dimension greater than the screen openings is transported up and away from the processed residual stream using at least one negative pressure air separation such that the composition of the processed residual stream after removal of the first and second fractions, is at least between about 30% and 60% by weight of plastics with number designations 1-7 and paper based items including newsprint, cardboard, and film; optionally, a method comprises an additional, initial step of processing through at least one shaker screen comprising openings greater than 6±0.5 inches in a lateral dimension wherein an initial fraction with dimensions greater than the at least one shaker screen of the additional, initial step is separated; optionally, a method comprises an additional step of processing the second fraction through a first optical recognition system comprising a first data base operable to distinguish components of the second fraction such that the velocity of the positive pressure air of the first part of the first air separation module is determined by the settings of the optical recognition system and wherein current data acquired by the first optical recognition system is stored in the first data base; optionally, a method comprises an additional step of calculating the weight of the second fraction based upon data collected by the optical recognition system.

A "mixed rigid bale" has two general definitions. First, a mixed rigid bale comprises a bale of mixed plastics numbers 3 through 7, generally, including commingled bottles and containers, 3-7 bottles, and 1-7 containers and/or all bottles and containers in some instances. Secondly, a mixed rigid bale is a bale of material comprising mixed plastics including plastics left over after a first MRF removes plastics #1 and #2; it may also include large size plastics comprising plastic swimming pools, plastic toys, landscape pails and anything easily removed by a "sorting" person. The large plastic in a mixed rigid bale may require an additional processing step. In some embodiments of the instant invention configured for processing mixed rigid bales comprising large plastic an additional screen is added to the beginning of the disclosed separation process such that items greater than 12" are removed by using a vibratory screen or trammel; the greater than 12" stream may be transported to a shredder to reduce sizes to about 6" or less. At this reduced size the separated material is sent to a vibratory screen or trammel via a return belt and optically sorted by resin type. Adding a larger screen and shredder system provides an opportunity to process mixed rigid bales comprising large plastic items through various embodiments of the instant invention.

As used herein the "apparent density" of an object is similar to the definition of specific gravity; for example a 1 liter bottle filled with 500 grams of liquid, such as water, has an apparent density of about 0.5; or a 100 ml bottle with 10 grams of liquid has an apparent density of about ≈10/100. These water bottles without the liquid would have apparent densities of about 2/500 and 1/100 respectively. The apparent density is the ratio of an object's gross weight to its gross volume, $g/cm^3$. The apparent density of an object is a key parameter for classification by a pneumatic separator employing varying air velocities.

It will also be understood that, although the terms first, second, etc. may be used herein to describe various elements, these elements should not be limited by these terms. These terms are only used to distinguish one element from another. For example, a first layer could be termed a second layer, and, similarly, a second layer could be termed a first layer, without departing from the scope of the present invention.

The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of the invention.

Unless otherwise defined, all terms used in disclosing embodiments of the invention, including technical and scientific terms, have the same meaning as commonly understood by one of ordinary skill in the art to which this invention belongs, and are not necessarily limited to the specific definitions known at the time of the present invention being described. Accordingly, these terms can include equivalent terms that are created after such time. It will be further understood that terms, such as those defined in commonly used dictionaries, should be interpreted as having a meaning that is consistent with their meaning in the present specification and in the context of the relevant art and will not be interpreted in an idealized or overly formal sense unless expressly so defined herein. All publications, patent applications, patents, and other references mentioned herein are incorporated by reference in their entirety.

I claim:

1. A secondary separation system for recyclables for processing a stream from a MRF, Materials Recycling Facility, comprising;

a means for conveying;

a screen comprising openings greater than about 2.0±1.0 inches in a lateral dimension such that a first fraction comprising material with a lateral dimension less than the screen openings falls through the screen openings and is no longer part of the stream;

a first air separation module comprising a first part of positive pressure air and a second part of negative pressure air operating such that the second part transports a fraction comprising material with an apparent density less than a first predetermined number and a lateral dimension greater than the screen openings up and away from the stream wherein the remaining, processed stream consists of matter made up of components with an apparent density greater than the first predetermined number and a lateral dimension greater than the screen openings and wherein the second fraction is separated into a lighter second fraction and a heavier second fraction by the second part of the air separation module wherein the lighter second fraction is conveyed away from the heavier second fraction and wherein the processed stream exiting the first air separation module comprises between about 20% and 40% by weight of recyclable stream material; and a first optical recognition system comprising a first data base operable to distinguish components of the second fraction such that the velocity of the positive pressure air of the first part of the first air separation module is determined by the settings of the optical recognition system and wherein current data acquired by the first optical recognition system is stored in the first data base.

2. The secondary separation system of claim 1 comprising a second air separation module comprising a first part of positive pressure air and a second part negative air system operating such that the second part transports a third fraction comprising material with an apparent density less than a second predetermined number and a lateral dimension greater than the screen openings up and away from the stream wherein the remaining, processed stream consists of matter made up of components with an apparent density greater than the second predetermined number and a lateral dimension greater than the screen openings and wherein the third fraction is separated into a lighter third fraction and a heavier third fraction by the second part of the second air separation module and wherein the processed stream exiting the second air separation module comprises between about 30% and 60% by weight of recyclable material.

3. The secondary separation system of claim 1 further comprising a second optical recognition system comprising a second data base operable to distinguish components of the third fraction such that the velocity of the positive pressure air of the first part of the second air separation module is determined by the settings of the second optical recognition system and wherein current data acquired by the second optical recognition system is stored in the second data base.

4. The secondary separation system of claim 3 further comprising a tertiary sorter positioned after the second air separation module wherein the processed stream into the tertiary sorter is characterized by the fact that the composition of the processed stream comprises between about 20% and 40% by weight of non-recyclable material.

5. The secondary separation system of claim 3 wherein the first and second data bases comprise historical data specific to the stream from a MRF being processed such that the first and second optical recognition systems can compare the current data to the historical data.

6. A composition of matter derived by processing a residual stream comprising at least 10% by weight of plastics with number designations 1-7 and 20% by weight of paper based items including newsprint, cardboard, and film from a MRF, Materials Recycling Facility, operating with conventional equipment wherein the residual stream is processed through at least one shaker screen comprising openings greater than 2±1.0 inches in a lateral dimension wherein a first fraction with a dimension less than 2±1.0 inches is removed and is processed through at least one air separation module operating such that a second fraction comprising material with a apparent density less than 0.1 and a lateral dimension greater than the screen openings is transported away from the processed residual stream using at least one negative pressure air separation such that the composition of the processed residual stream after removal of the first and second fractions, is between about 40% and 60% by weight of plastics with number designations 1-7 and paper based items including newsprint, cardboard, and film; and wherein the second fraction is processed through a first optical recognition system wherein the weight of the plastics of the second fraction is calculated based upon data collected by the optical recognition system.

7. A method for processing a residual stream from a MRF, Materials Recycling Facility, comprising the steps;

processing through at least one shaker screen comprising openings greater than 2±1.0 inches in a lateral dimension wherein a first fraction with a dimension less than 2±1.0 inches is removed;

processing through at least one air separation module operating such that a second fraction comprising material with a apparent density less than 0.1 and a lateral dimension greater than the screen openings is transported up and away from the processed residual stream using at least one negative pressure air separation such that the composition of the processed residual stream after removal of the first and second fractions, is at least between about 30% and 60% by weight of plastics with number designations 1-7 and paper based items including newsprint, cardboard, and film;

processing the second fraction through a first optical recognition system; and calculating the weight of the plastics of the second fraction based upon data collected by the optical recognition system.

8. The method of claim 7 comprising an additional, initial step of processing through at least one shaker screen comprising openings not greater than 6±0.5 inches in a lateral dimension wherein an initial fraction with dimensions greater than the at least one shaker screen of the additional, initial step is separated.

9. The method of claim 7 comprising an additional step of processing the second fraction through a first optical recognition system comprising a first data base operable to distinguish components of the second fraction such that the velocity of the positive pressure air of the first part of the first air separation module is determined by the settings of the optical recognition system and wherein current data acquired by the first optical recognition system is stored in the first data base.

* * * * *